US012043438B2

(12) United States Patent
Menear et al.

(10) Patent No.: US 12,043,438 B2
(45) Date of Patent: Jul. 23, 2024

(54) SEPARATOR ASSEMBLY FOR MODULAR FILING SYSTEMS

(71) Applicant: Liqui-Box Corporation, Richmond, VA (US)

(72) Inventors: Tad Menear, Bridgeton, NJ (US); John J Hildebrand, Corona, CA (US)

(73) Assignee: Liqui-Box Corporation

( * ) Notice: Subject to any disclaimer, the term of this patent is extended or adjusted under 35 U.S.C. 154(b) by 218 days.

(21) Appl. No.: 17/701,871

(22) Filed: Mar. 23, 2022

(65) Prior Publication Data

US 2022/0212828 A1 Jul. 7, 2022

Related U.S. Application Data

(62) Division of application No. 16/592,701, filed on Oct. 3, 2019, now Pat. No. 11,358,745.

(60) Provisional application No. 62/740,600, filed on Oct. 3, 2018.

(51) Int. Cl.

| | |
|---|---|
| ***B65B 61/06*** | (2006.01) |
| ***B65B 9/12*** | (2006.01) |
| ***B65B 57/02*** | (2006.01) |

(52) U.S. Cl.

CPC ..... *B65B 61/06* (2013.01); *B65B 9/12* (2013.01); *B65B 57/02* (2013.01)

(58) Field of Classification Search

CPC ..... B65B 61/06; B65B 9/12; B65B 57/02; B65B 59/04

See application file for complete search history.

(56) References Cited

U.S. PATENT DOCUMENTS

| | | | | |
|---|---|---|---|---|
| 4,297,929 | A | 11/1981 | Schieser | |
| 4,865,091 | A | 9/1989 | Thomsen | |
| 5,129,212 | A | 7/1992 | Duffey | |
| 5,531,061 | A * | 7/1996 | Peterson | B65B 61/06 53/529 |
| 6,629,400 | B1 * | 10/2003 | Offermann | B29C 66/9241 53/374.6 |
| 6,725,633 | B2 | 4/2004 | Resterhouse | |
| 2003/0033704 | A1 * | 2/2003 | Resterhouse | B23P 19/00 29/426.1 |

(Continued)

FOREIGN PATENT DOCUMENTS

| | | | |
|---|---|---|---|
| EP | 1577052 | A2 | 9/2005 |
| KR | 1020070102105 | | 7/2008 |
| WO | 2017137360 | A1 | 8/2017 |

OTHER PUBLICATIONS

PCT, Notification Concerning Transmittal of International Preliminary Report on Patentability, Application No. PCT/US2019/054585, Apr. 15, 2021 (10 pages).

*Primary Examiner* — Joshua G Kotis
*Assistant Examiner* — Scott A Howell
(74) *Attorney, Agent, or Firm* — MCANDREWS HELD & MALLOY, LTD

(57) ABSTRACT

A separator assembly for separating adjacent flexible bags in a filling assembly includes a body defining an opening therethough, a surface defined on the body within the opening, a clamp movable in the opening and configured to selectively contact the surface, a separator blade movable within the opening, a rail, and a rail guide configured to slidably engage with the rod. The separator assembly is movable along the rail. Methods of moving the separator assembly are also disclosed.

8 Claims, 11 Drawing Sheets

(56) References Cited

U.S. PATENT DOCUMENTS

| | | | | |
|---|---|---|---|---|
| 2004/0163518 | A1* | 8/2004 | Resterhouse | B65B 61/04 83/451 |
| 2009/0260326 | A1* | 10/2009 | Grimm | B65B 61/005 53/512 |
| 2010/0061666 | A1 | 3/2010 | Sprehe | |
| 2017/0080634 | A1 | 3/2017 | Honegger | |
| 2019/0016488 | A1* | 1/2019 | Peccetti | B65B 21/245 |

* cited by examiner

SEPARATOR ASSEMBLY FOR MODULAR FILING SYSTEMS

CROSS-REFERENCE TO RELATED APPLICATIONS

This application is a Divisional of U.S. patent application Ser. No. 16/592,701, filed Oct. 3, 2019, which claims the benefit of U.S. Provisional Application No. 62/740,600, filed Oct. 3, 2018, the entirety of which is incorporated herein for any and all purposes.

TECHNICAL FIELD

This disclosure generally relates to devices and methods of filling flexible containers with flowable materials, and more particularly relates to adjustable and automated assemblies for separating flexible containers as they are filled in filler assemblies.

BACKGROUND

Liquid filling and packaging requires many different steps and separate components. Depending on the desired setup, the process from start to finish can include preparing the liquid, preparing the packaging, moving the liquid into the package, and sealing the package with the liquid therein, as well as other steps, such as sterilizing, labeling, and organizing the packaging with liquid for storage or transportation. Each component responsible for any of the necessary steps must be maintained, serviced, and prepared such that it can work with each of the other related components. As more components are introduced into a system, more control is necessary to ensure proper interaction between all of the components to prepare the final product. Additionally, the assembly-line-type structure of the system often requires a specific order of processes. Such requirements result in needing multiple large machines and inconvenient component setups. It is often difficult to change one or more components in such systems in order to prepare a different product. Similarly, components are difficult to remove or replace. As such, it is desirable to have an assembly system that can operate with different interchangeable components that can be organized as necessary.

Because containers having different sizes, dimensions, shapes, and materials may be used, filler assemblies have to be configured to operate with different parameters, or, alternatively, separate filler assemblies must be utilized. When components of filler assemblies, such as container separating components, have to be moved or adjusted to correspond to a specific container type, the process is often long, requires many operators to complete, and results in inconsistencies or errors. Therefore, there is a need for better automated movement and adjustment of components, such as separating components, to correspond to different container types.

SUMMARY

The foregoing needs are met by various aspects of separator assemblies and related components disclosed. According to an aspect of this disclosure, a separator assembly for separating adjacent flexible bags in a filling assembly includes a body defining an opening therethough, a surface defined on the body within the opening, a clamp movable in the opening and configured to selectively contact the surface, a separator blade movable within the opening, a rail, and a rail guide configured to slidably engage with the rod. The separator assembly is movable along the rail.

In some aspects, the separator assembly may further include a rail lock configured to releasably prevent movement of the separator assembly along the rail.

The clamp may include a front clamp and a rear clamp, wherein a gap is defined between the front clamp and the rear clamp. In some aspects, the separator assembly may include a plurality of clamps. The clamp or plurality of clamps may include a rubber layer defined thereon, such that when the clamp is in contact with the surface, the rubber layer is disposed between the clamp and the surface.

In some aspects, the separator blade may have a wave cross-section and may define a plurality of peaks and valleys.

In some aspects, the separator assembly may be configured to releasably engage with a movable body, the movable body being movable along a second rail by a motor operationally connected to the movable body. The separator assembly may include a locking pin, and the movable body may include a receptacle configured to receive the locking pin therein. The locking pin may be movable between a first position in which the locking pin is not within the receptacle and a second position in which the locking pin is within the receptacle. The separator assembly may include a controller and a sensor configured to detect the position of the receptacle relative to the locking pin. The sensor may be configured to send an electronic signal to the controller when the locking pin is adjacent to the receptacle. The sensor may be an optical sensor. The controller may be configured to send a signal to the motor to actuate movement of the movable body or to terminate movement of the movable body. The controller may further be configured to send a signal to the locking pin to selectively move between the first position and the second position.

According to another aspect of the disclosure, a method of positioning a separator assembly to a predetermined location within a container filling assembly includes the steps of actuating a motor to move a movable body along a rail towards the separator assembly; aligning the movable body with the separator assembly; releasably coupling the movable body to the separator assembly; moving the separator assembly to the predetermined location; and decoupling the movable body from the separator assembly.

In some aspects, the separator assembly may include a lock configured to preclude movement thereof, and the method may further include disengaging the lock before the step of moving the separator assembly to the predetermined location. The method may further include re-engaging the lock after the step of moving the separator assembly to the predetermined location.

In some aspects, the separator assembly may include a sensor configured to detect movement of the movable body relative to the separator assembly, and the aligning step may include determining, via the sensor, when the movable body is positioned at a predetermined alignment position relative to the separator assembly.

In some aspects, one of the separator assembly and the movable body may include a locking pin, and the other of the separator assembly and the movable body may include a receptacle configured to removably receive the locking pin. The coupling step may further include moving the locking pin into the receptacle, and the decoupling step may further include moving the locking pin out of the receptacle.

The method may further include communicating with a controller, the controller being configured to send electronic signals to the motor to operate the motor.

The method may further include selecting a type of container to be used before the step of actuating the motor, wherein the predetermined location may be based on the selecting step.

The method may further include moving the movable body to a second position different from the predetermined position after the decoupling step.

According to another aspect, a filler assembly for forming and filing a flexible container with a flowable material is disclosed that includes a movable separator assembly as described herein.

BRIEF DESCRIPTION OF THE DRAWINGS

The present application is further understood when read in conjunction with the appended drawings. For the purpose of illustrating the subject matter, there are shown in the drawings exemplary aspects of the subject matter; however, the presently disclosed subject matter is not limited to the specific methods, devices, and systems disclosed. In the drawings.

Aspects of the disclosure will now be described in detail with reference to the drawings, wherein like reference numbers refer to like elements throughout, unless specified otherwise.

DETAILED DESCRIPTION OF ILLUSTRATIVE EMBODIMENTS

Figure 1:
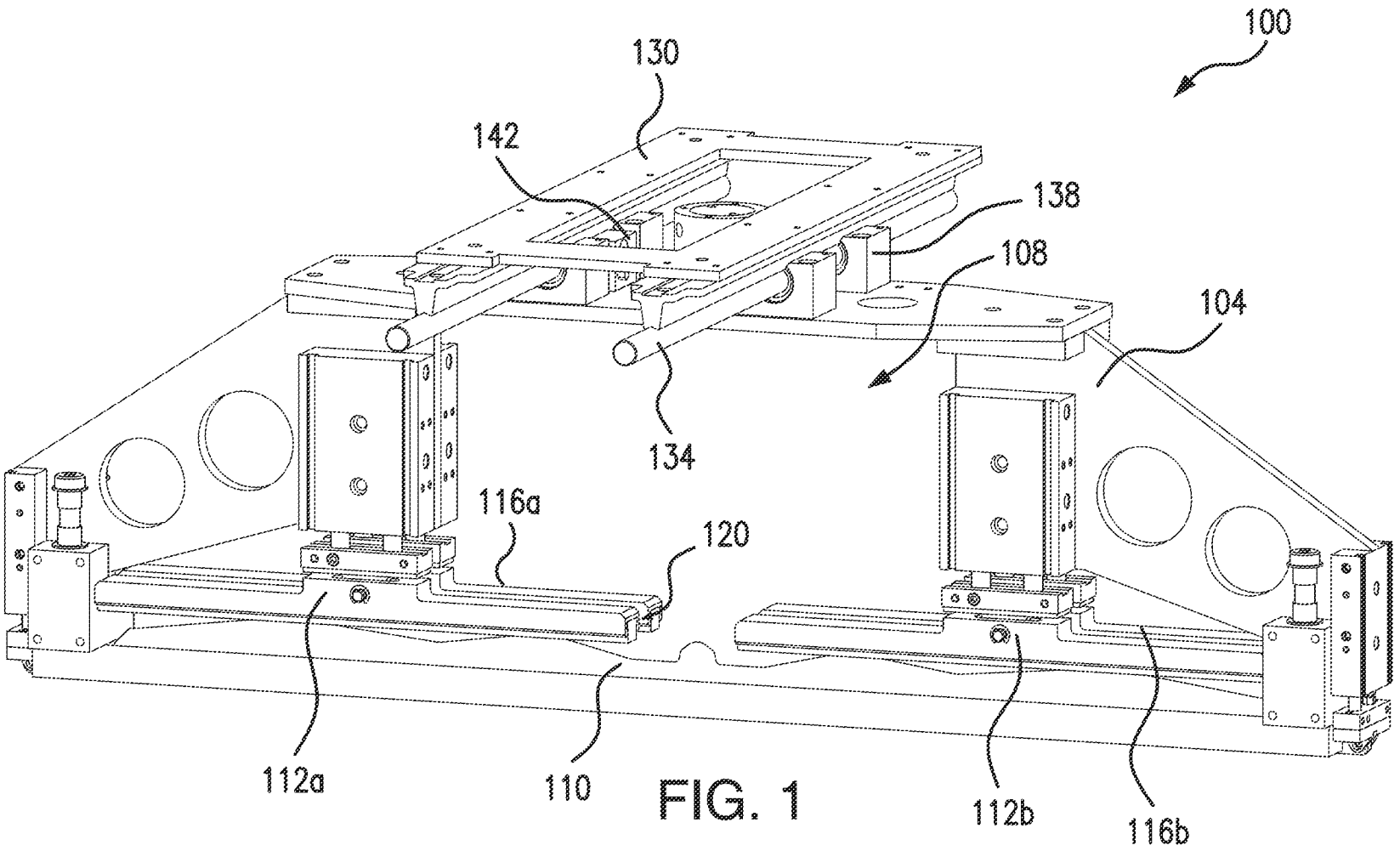
FIG. 1 illustrates an isometric perspective view of a separator assembly according to an aspect of the disclosure.
Figure 2:
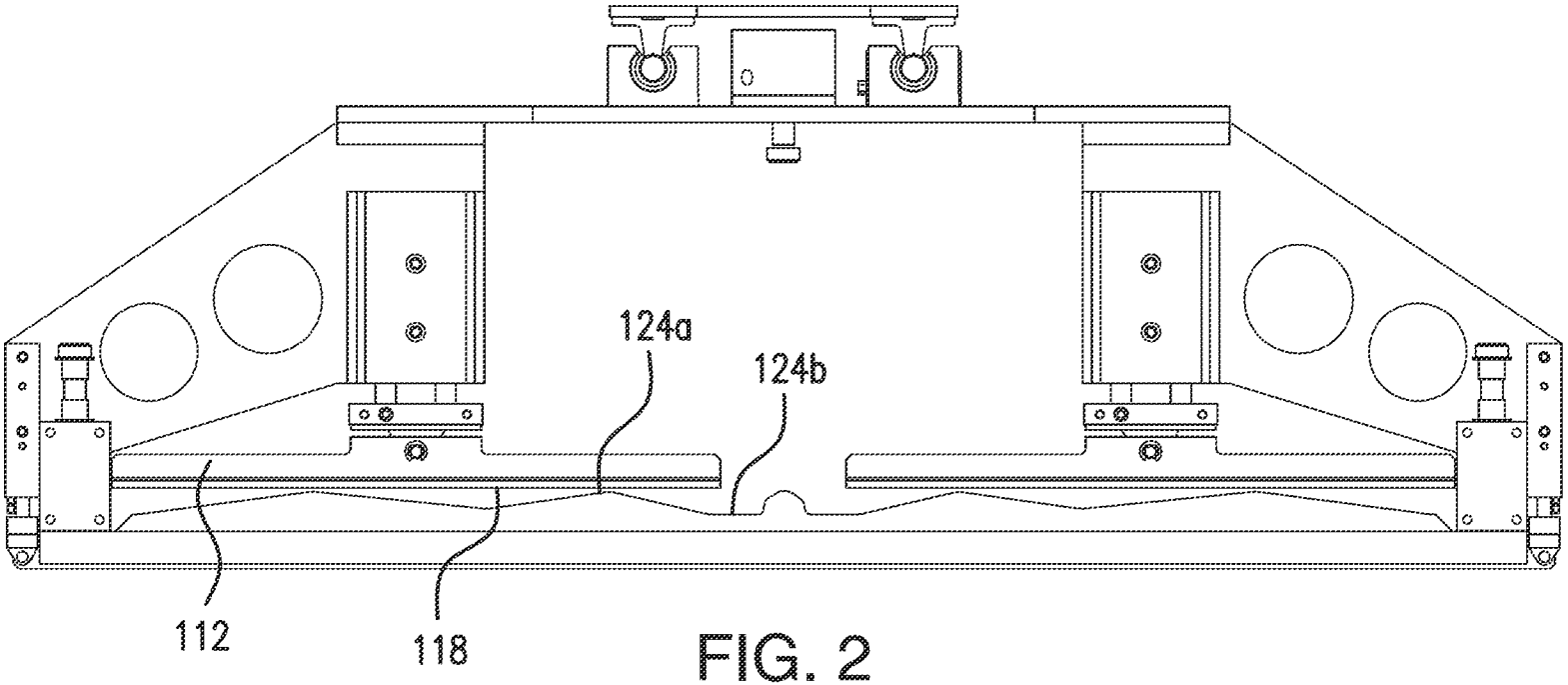
FIG. 2 illustrates a front perspective view of the separator assembly of FIG. 1.
Figure 3:
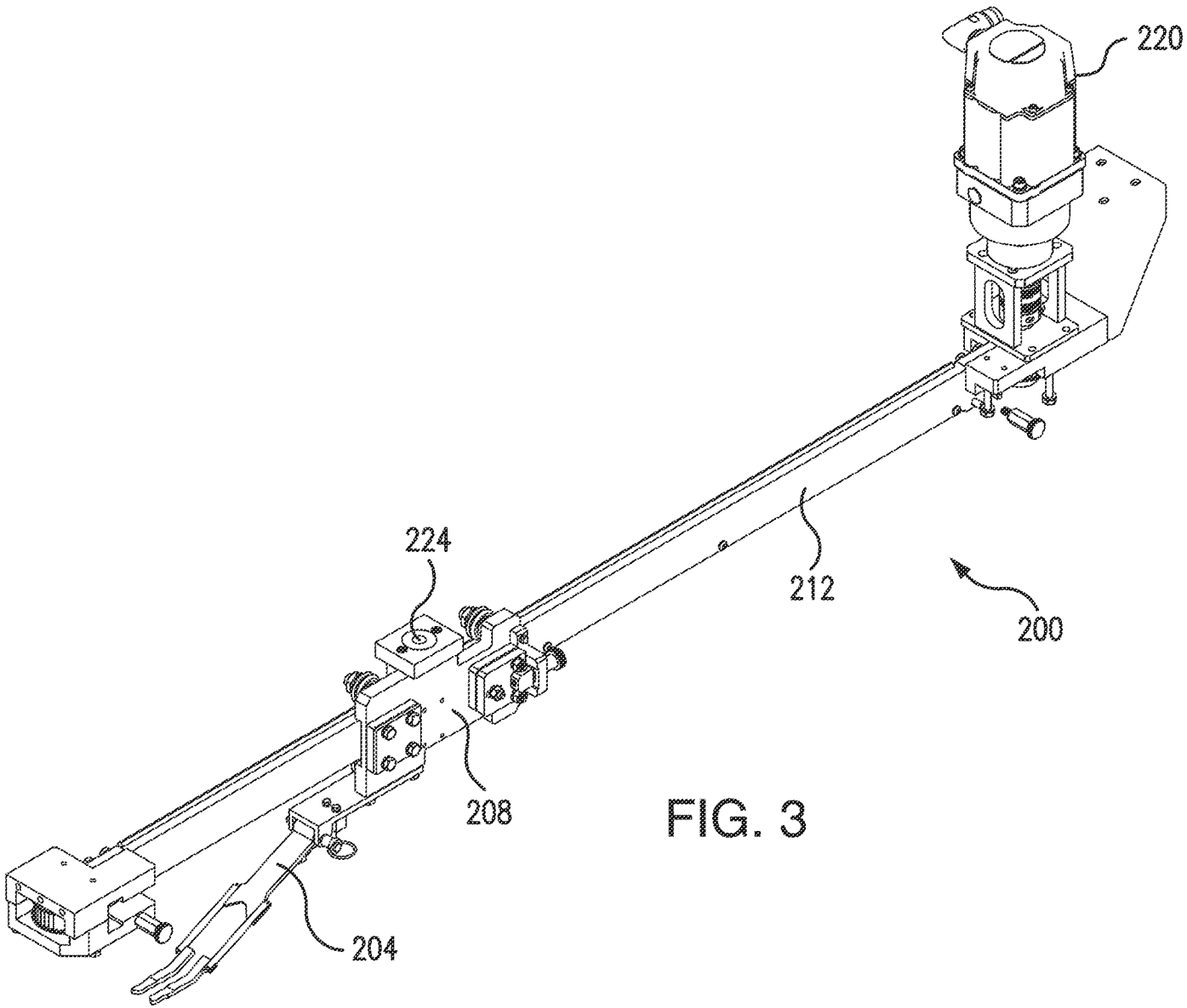
FIG. 3 illustrates an isometric perspective view of a pusher assembly according to an aspect of the disclosure.
Figure 4:
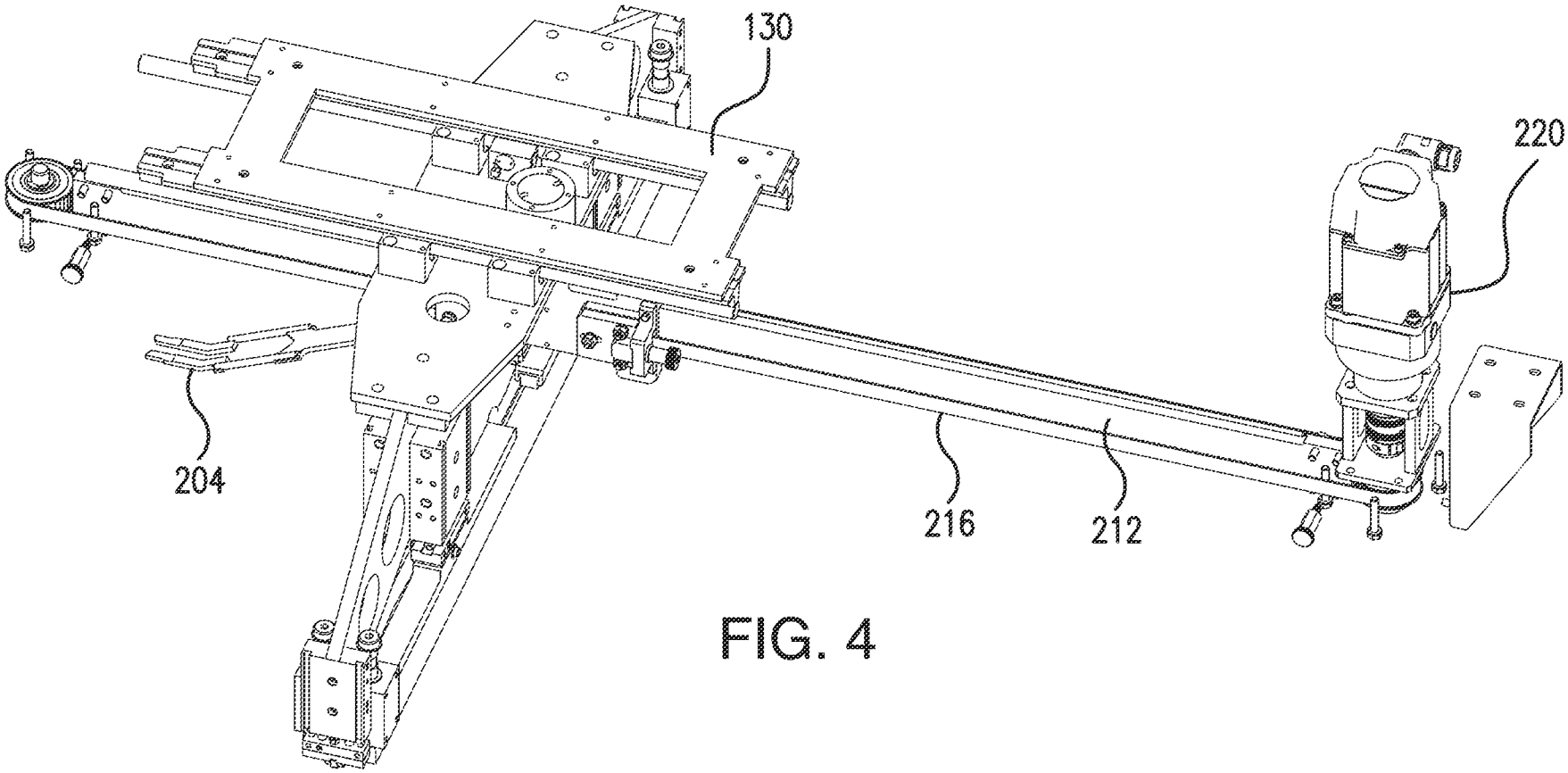
FIG. 4 illustrates an isometric perspective view of a separator assembly and a pusher assembly according to an aspect of the disclosure.

Filler assemblies are used with flowable substances and flexible containers, such as bags. The filler assemblies can form, fill, seal, and/or prepare the bags for shipment. It will be appreciated that the same filler assembly can be utilized for one or more of the above steps, or, alternatively, separate filler assemblies can be used that are responsible for different stages of the process The disclosed filler assemblies should be designed to use as many components that are used in filling processes as possible. The filler assembly can be operated with a wide range of pouch sizes, spouts and caps, fill orientations, and various loading methods, such as side loading, flat drop, spout trailing, spout leading, and front and rear discharge. A filling area should be designed to handle a variety of filling requirements, such as ambient fill, ESL, Aseptic, Hot-fill, and other suitable filling concepts. The components present in the filler assembly allow for modularity of design, quick changeover and adjustments, and tool-less design considerations.

The filler machine assembly can operate with a wide range of suitable products and processing protocols. Suitable products include, but are not limited to, wine, syrup, water, carbonated beverages, other beverages, and industrial products. It will be under stood that the filling and production rate will depend on the product type, the fitment size, the specific components within the assembly, and other parameters of the filler machine assembly.

Depending on the specific arrangement of the filler machine assembly, the assembly may operate at different filling rates, for example, at 10 to 200 gallons per minute (GPM), at 40 to 150 GPM, at 60 to 100 GPM, at 80 to 90 GPM, or at another suitable range of filling rates. The assembly can be designed to fill the desired number of bags at different rates that can be adjusted based on the product, bag size, and other components in the assembly. In some aspects, the machine can fill 1-gallon bags at a rate of at least 10 bags per minute (BPM), preferably at least between 12 and 14 BPM. For 2.5-gallon bags, the assembly may be designed to fill the bags at a rate of at least between 10 and 12 BPM. For 5-gallon bags, the assembly may be designed to fill the bags at a rate of at least between 8 and 10 BPM. It will be understood that it will be preferable to achieve higher filling rates where possible without sacrificing quality or elimination necessary steps.

The filler machine assembly may utilize any suitable flow meter to measure the flow of the product being introduced into the bags.

While any suitable materials can be used to manufacture the filler machine assembly, it will be appreciated that the assembly should withstand repetitive use and be easily serviced, cleaned, and sterilized. A frame of the assembly may be constructed of a metal, such as stainless steel. In some aspects, the frame includes 304 stainless steel. The frame may include non-metal components, which should be approved for use in food applications.

The assembly may include various components for preparing a bag with a product therein. The assembly may include an inlet for the bag and/or product, a bag separator, a bag loader, a filling head, a capping assembly, and a suitable exit for the final product out of the assembly.

A bag separating component may be present in the filler assembly to physically separate adjacent bags (or other flexible containers) as they are processed and filled in the filler assembly. The flexible containers (e.g. bags) may be introduced into the filler assembly as a plurality of flexible containers that are serially connected, one after another, in a suitable arrangement, such as flat sheets or rolls. Each individual flexible container is separated from the next flexible container by a separation region. In some aspects, this separation region may be a perforated region made from the same material as the rest of the flexible container but also having one or more punctures extending therethrough to allow for easier ripping, tearing, or other separation. It will be appreciated that the specific pattern of perforations can be designed based on the type of flexible container being used, the separating mechanism, the materials of the flexible container, or manufacturing constraints.

Various separating mechanism may be utilized to separate the connected adjacent flexible containers, such as guillotine-type separators (which have a movable blade that moves towards the perforated region and severs the entire perforated region substantially at the same time) or zipper-type separators (which have a movable blade that moves along the length of the perforated region and severs the perforated region from one end to the other end thereof). Other suitable separator types are envisioned, and it will be appreciated that the particular type of separator does not limit the scope of this application.

In existing filler assemblies, a separator is manually positioned in the desired location. The specific desired location depends on the size of flexible container that is used, the type of connecting or perforated region, the positioning of other components of the filler assembly, and other manufacturing constraints. This process is tedious and requires one or more operators to physically release the separator, move it to the proper location, and affix it in the new location. This requires extra time do accomplish and slows down manufacturing, as well as requires operators to be trained and available to perform this task. Additionally, the manual movement of the separator is prone to inconsistencies in placement of the separator, as well as other human error, such as improper securing of the separator, incorrect location placement, or other mistakes.

Alternatively, a mechanized setup may be utilized, in which the separator is moved via a motor to the desired location. However, such setups require having a dedicated motor, track, and other movement components that are reserved for moving the separator to the desired locations. This is often undesirable because of the added cost associated with the necessary components, as well as the added weight and complexity of the extra components in the already-complex filler assembly. Adding more of the above features also reduces space inside the filler assembly, requiring expanding the filler assembly to house all of the necessary components, thus increasing the footprint and requiring more manufacturing space to be designated for each filler assembly.

Disclosed are aspects of filler assemblies that utilize existing moving components of the filler assembly to automate movement of the separator assembly. Referring to FIGS. 1-9, a separator assembly 100 is disclosed. The separator assembly 100 includes a body 104 that defines therethrough an opening 108 that is configured to receive one or a plurality of flexible containers 1 (e.g. flexible bags 1). The flexible container 1 may be a flexible bag 1 configured to receive a flowable material therein. Although "bag" and "flexible container" may be used interchangeably throughout this application, it will be appreciated that other types of flexible containers may be utilized. A plurality of bags 1 includes individual bags attached to each other, for example serially or in a row, and being separated from one another by a separation region 2, which may include a perforation. The plurality of bags 1 may be introduced into the opening 108 of the body 104 and, when in the desired position, the separation region 2 may be severed to separate an individual bag 1 from the plurality of bags.

The body 104 has a substantially flat surface 110 within the opening 108. The bags 1 are positioned on the surface 110 when inserted into the opening 108. A clamping mechanism operates to releasably secure the bags 1 within the separator assembly 100 during the separation process. As shown in the figures, the separator assembly 100 may have a front clamp 112 and a rear clamp 116, with both clamps 112, 116 being configured to move towards and away from the surface 110. Each of the front and rear clamps 112, 116 is configured to contact the surface 110 in a closed configuration and to be spaced away from the surface 110 in an open configuration. When the clamps 112, 116 are in the open configuration, the bag 1 may be moved and positioned within the opening 108 between the clamps 112, 116 and the surface 110. When the clamps 112, 116 are in the closed configuration, the bag 1 is fixedly secured between the clamps 112, 116 and the surface 110.

A gap 120 is defined between the front clamp 112 and the rear clamp 116 and is configured to receive a separator blade 124 therethrough. The separator blade 124 is configured to be moved within the opening 108 between the surface 110 and the front and rear clamps 112, 116. The separator blade 124 may have any suitable shape and dimensions, but it will be understood that the selected shape and dimensions should allow for the separator blade 124 to contact and sever the separation region 2 (e.g. at the perforation). The separator blade 124 may be substantially uniform throughout, or it may have a shape or dimensions that vary along its body. In some aspects, the separator blade 124 may be substantially rectangular or trapezoidal.

In other aspects, the separator blade 124 may have an irregularly shaped cross section. As shown in the exemplary aspect of FIGS. 1-2, the separator blade 124 may include a plurality of peaks 124*a* and valleys 124*b* and may have a sinusoidal or wave-shaped cross section. Such a shape may be advantageous because it allows the separator blade 124 to first contact the separation region 2 with the peaks 124*a* rather than with the entire surface of the separator blade 124, which results in a greater pressure being applied by the separator blade 124 onto the bag 1, which in turn facilitates severing the separation region 2 by requiring relatively less movement force of the separation blade 124 than would otherwise be required if the force were not concentrated to the one or more peaks 124*a*.

Figure 5:
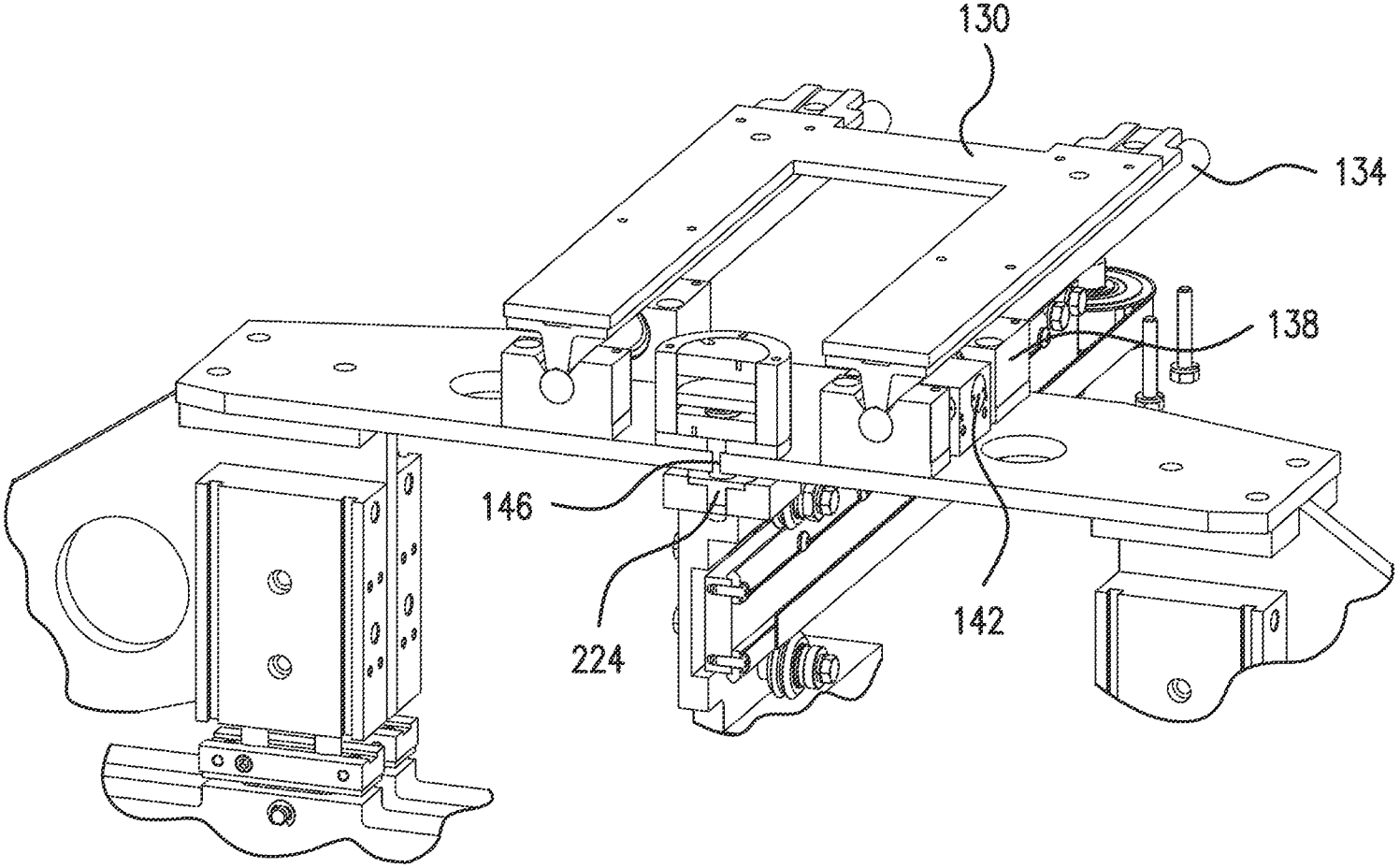
FIG. 5 illustrates a cross-sectional isometric view of the separator assembly and the pusher assembly of FIG. 4.
Figure 6:
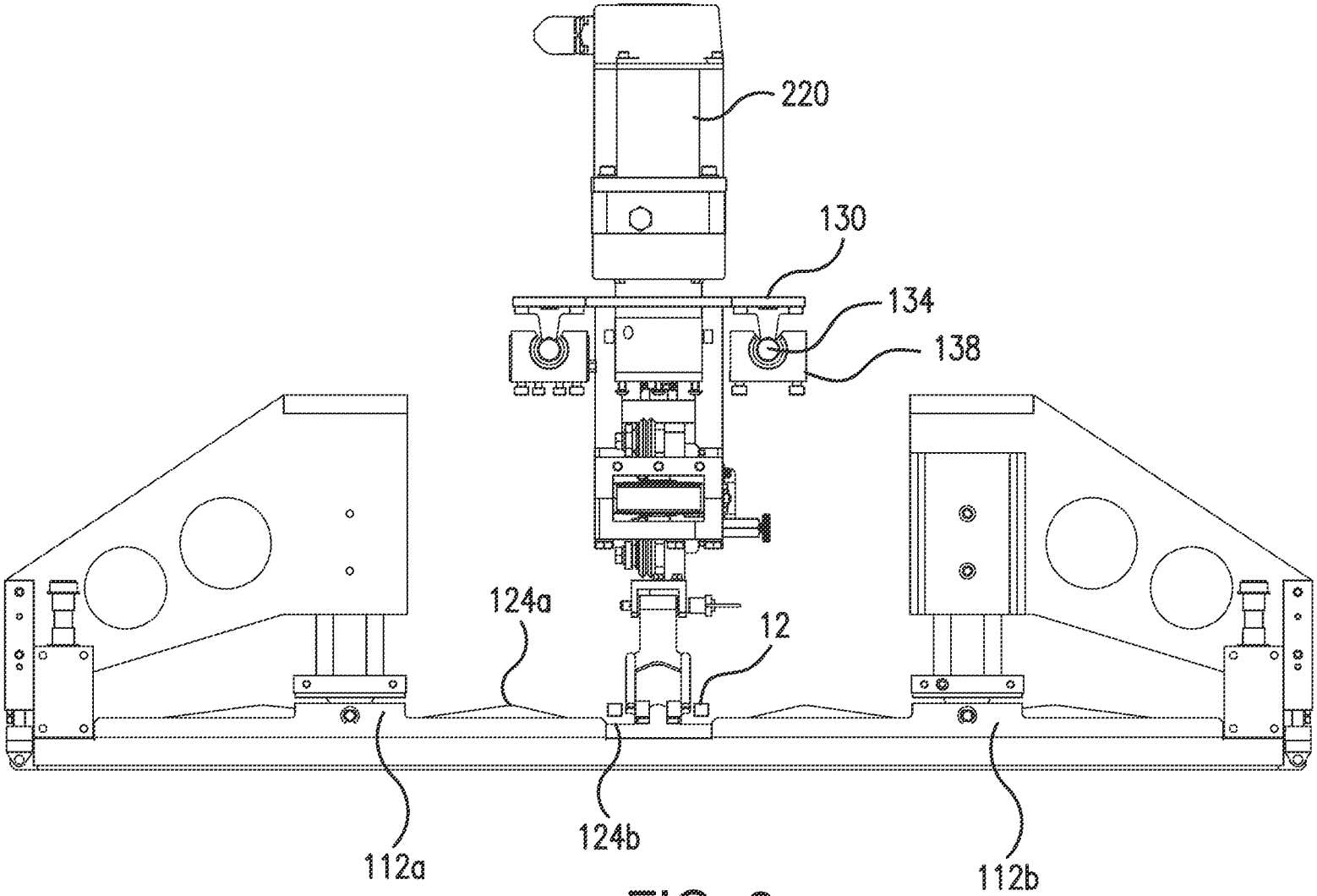
FIG. 6 illustrates a front perspective view of a separator assembly with the clamps in a closed configuration according to an aspect of the disclosure.

In some aspects, it may be further advantageous to have a separator blade 124 shaped as described above to allow components of the filler assembly 10 to be disposed near or in the separator assembly 100 without having to change those components. For example, referring to FIG. 5, it can be seen that several frame components 12, such as rails, of the filler assembly 10 are disposed to be at least partly within the opening 108 of the separator body 104. The separator blade 124 is shown to be dimensioned in such a way that the valleys 124*b* are substantially located below the frame components 12, allowing the frame components 12 to occupy the space between adjacent peaks 124*a*. FIG. 5, for example, depicts the separator assembly 100 where the front and rear clamps 112, 116 are in the closed configuration and the separation blade 124 is extended in the gap 120. Also shown are frame components 12 (e.g. guide rails for the bag 1) that are disposed substantially perpendicular to the movement of the separation blade 124. As evident from the figure, the presence of a peak 124*a* in the separation blade 124 allows for the frame components 12 to be disposed in the space between adjacent peaks 124*a*. In existing technology, such frame components 12 must be either positioned farther away (e.g. higher than the highest point the separation blade extends to) or they must include a gap or space therein to allow the separation blade to pass through. This requires additional structural components while also weakening the overall capabilities of the frame components. The dimensions and positioning of the disclosed separation blade 124 help overcome the above problems.

When the bag 1 is disposed in the opening 108 and contacts the surface 110, the front and rear clamps 112, 116 may be moved into the closed configuration to secure the bag 1 in the separator assembly 100. The front and rear clamps 112, 116 may apply as much force to the bag 1 as needed to fixedly secure the bag 1 against the surface 110, but it will be understood that the force applied should not be so great that the bag 1 is damaged during its application. To facilitate securing of the bag 1, the front clamp 112, the rear clamp 116, and/or the surface 110 may have an elastic layer 118 configured to provide better friction and grip with the bag 1 while being deformable enough to not damage the bag 1 when the clamps are in the closed configuration. In some aspects, the elastic layer 118 may include rubber.

When the front and rear clamps 112, 116 are in the closed configuration and the bag 1 is secured therein, the separation blade 124 is configured to be moved through the separation region 2 to completely separate adjacent bags 1 from one another. When the separation has been completed, the blade 124 may be moved away from the separation region, and the front and rear clamps 112, 116 can be moved away from the surface 110 into the open configurations. The bag 1 that was separated from an adjacently connected bag 1 can be moved to another part of the filler assembly 10.

It will be understood that different arrangements of clamps are possible. For example, the separator assembly 100 may have a set of clamps. Referring again to FIGS. 1-9, in some aspects, a set of a first front clamp 112*a* and a first rear clamp 116*a* may be positioned on one side of the body 104, and a second set of a second front clamp 112*b* and a second rear clamp 116*b* may be positioned on an opposite side of the body 104. Each set of clamps may operate in substantially the same manner, and it will be appreciated that separator assemblies may utilize a different number of clamp sets, such as one, three, four, or another suitable number.

The separator assembly 100 may be attached to a frame 130 of the filler assembly 10. The separator assembly 100 may also be movable relative to the filler assembly 10, such that the separator assembly 100 can be positioned in the desired location. The specific positioning will depend on the type and size of bag 1 that is being used with the filler assembly 10. The same filler assembly 10 and the same separator assembly 100 may be utilized with different types and sizes of bags 1. Accordingly, it may be advantageous to have the capability to move the separator assembly 100 to a predetermined location that corresponds to the specific type or size of the bag 1 being used. In practice, various bags 1 may be sized or dimensioned differently from other bags 1, and thus may have their respective separation regions 2 closer or farther apart from one another compared to different bags 1. As such, the separator assembly 100 may be moved to a predetermined location that corresponds to the known location of the separation region 2 of the bag 1 being used.

Movement of the separator assembly 100 is done along one or more rails 134 that may be fixedly attached to the frame 130. The one or more rails 134 are configured to slidably engage with one or more rail guides 138 disposed on the body 104. It will be understood that the above arrangement may be reversed, such that the one or more rails 134 are disposed on the body 104, while the one or more rail guides 138 are disposed on the frame 130 that is fixedly connected to the filler assembly 10.

A rail lock 142 is disposed on the body 104 or on the frame 130 and is configured to releasably secure the one or more rails 134 to prevent relative movement between the one or more rails 134 and the one or more rail guides 138, which, in turn, prevents relative movement between the separator assembly 100 and the filler assembly frame 130. The rail lock 142 may be actuated manually, for example by pushing a button, securing a clamp, or turning a screw, or it may be actuated automatically by a controller configured to send an electronic signal to a receiver on the rail lock 142. The receiver may then actuate a motor to selectively open or close the rail lock 142.

In some aspects, the separator assembly 100 may be movable relative to the filler assembly 10 by a pusher assembly 200. Referring to FIGS. 3-9, the filler assembly 10 may include a pusher assembly 200 that has a pusher 204 configured for moving the bag 1 within the filler assembly 10. The pusher 204 is attached to a movable body 208 that is slidably attached to and configured to move along a pusher rail 212, which may be a rail or pole. The movable body 208 may be connected to a belt 216, or another suitable movement actuation mechanism, that is operationally connected to a motor 220. Suitable motors include, but are not limited to, servo motor, stepper motor, linear motor, A/C motor, DC motor, air motor, pneumatic actuator, hydraulic actuation linear positioning encoder, or another suitable motor mechanism. Movement of the movable body 208 may be operated by a controller that receives commands from a program or from a user operator.

In addition to moving the pusher 204, the movable body 208 may be configured to also move the separator assembly 100. As shown in FIG. 5, the separator assembly 100 may include a locking pin 146 that is configured to releasably engage with a corresponding receptacle 224 defined on the movable body 208. It will be appreciated that the above arrangement may be reversed, such that the locking pin 146 is on the movable body 208 while the receptacle 224 is on the separator assembly 100.

Figure 7:
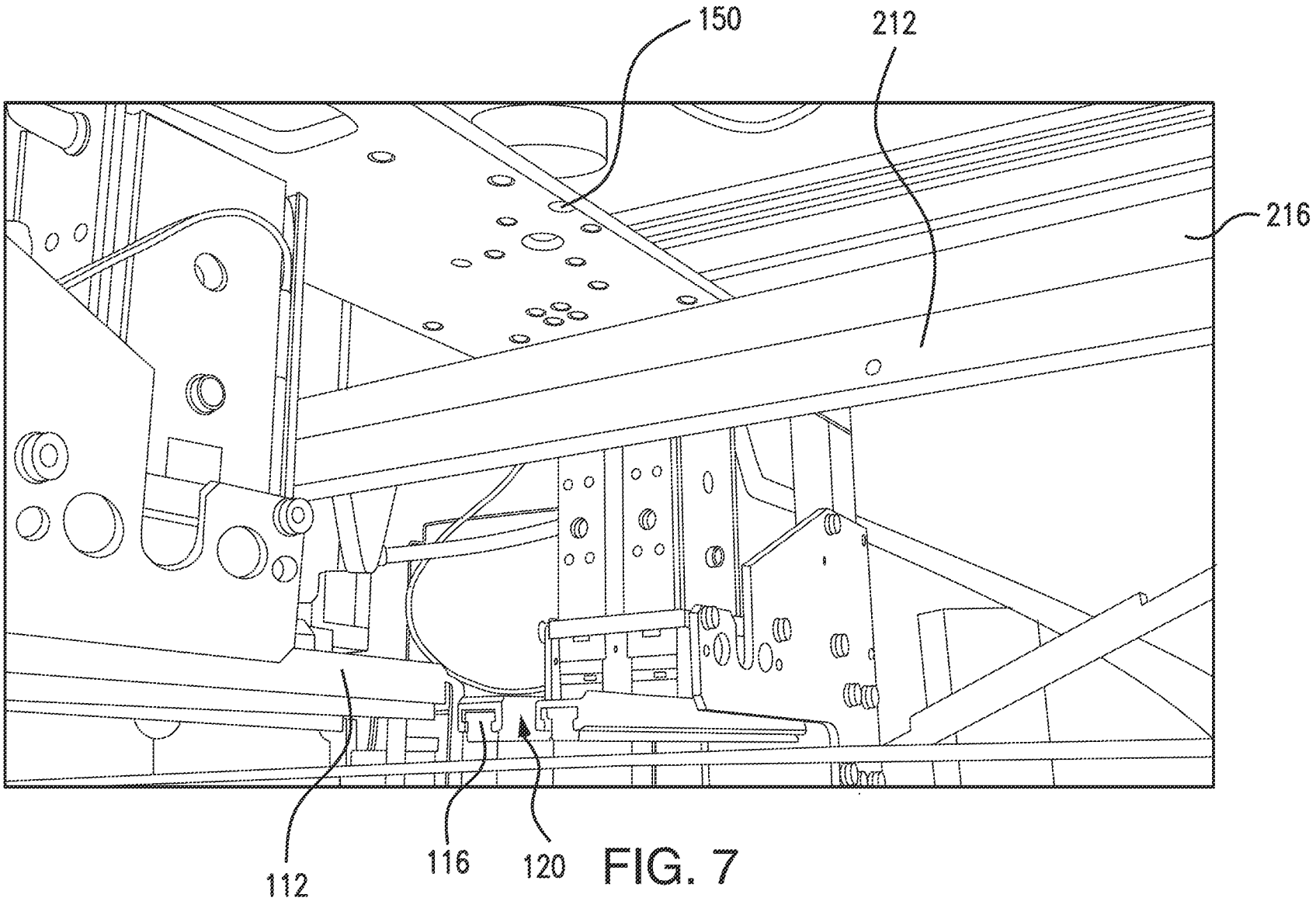
FIG. 7 illustrates an isometric perspective view of a pusher assembly and a separator assembly according to another aspect of the disclosure.
Figure 8:
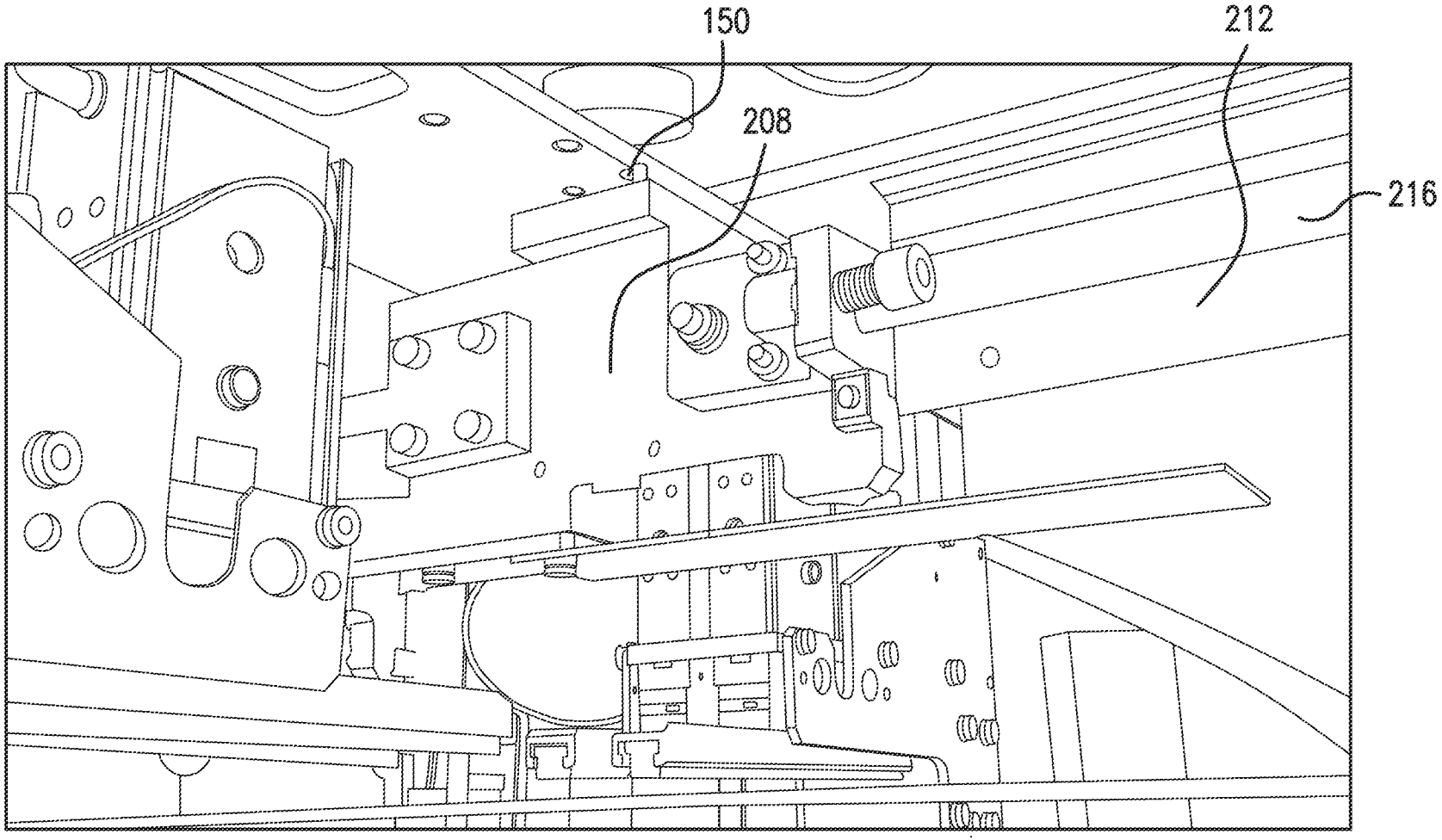
FIG. 8 illustrates an isometric perspective view of the pusher assembly of FIG. 7 coupled to the separator assembly of FIG. 7.
Figure 9:
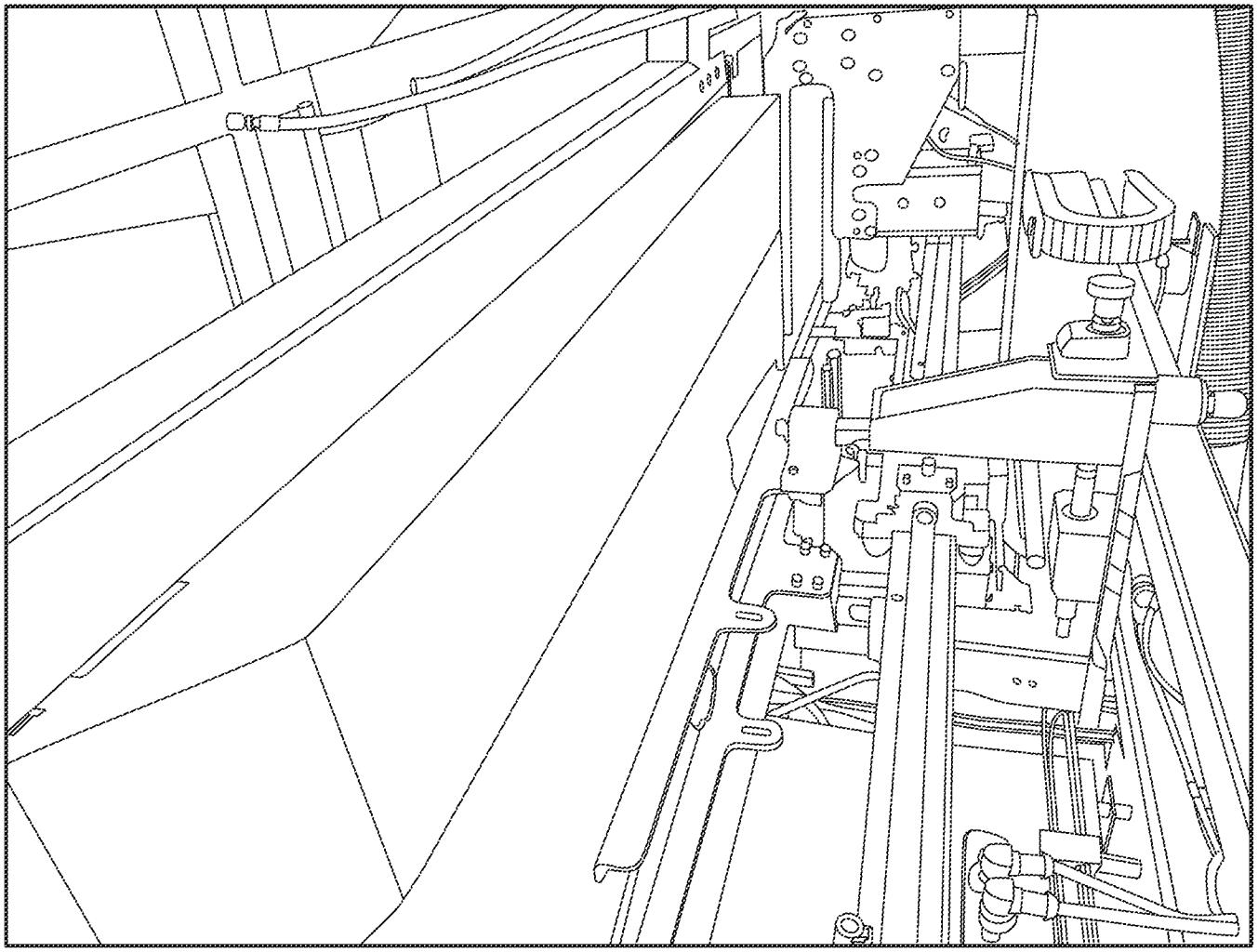
FIG. 9 illustrates an isometric perspective view of a filler assembly according to an aspect of the disclosure.

When the movable body 208 is moved along the pusher rail 212 such that the movable body 208 is adjacent the separator assembly 100, and the locking pin 146 is next to the receptacle 224, the locking pin 146 may be moved into the receptacle 224, and the movable body 208 may be coupled to the separator assembly 100, such that when the movable body 208 is moved along the pusher rail 212, the separator assembly 100 also moves along the one or more rails 134. The separator assembly 100 and the pusher assembly 200 may be aligned manually, for example, by an operator moving the movable body 208 such that the receptacle 224 is aligned with the locking pin 146, or the two assemblies may be aligned automatically. In some aspects, a sensor 150 may be disposed on at least one of the pusher assembly 200 or the separator assembly 100 that is configured to detect when the locking pin 146 and the receptacle 224 are aligned and to send an electronic signal to the controller, which in turn sends a signal instructing the locking pin 146 to engage with the receptacle 224 (for example, by sending a signal to a motor configured to move the locking pin 146 selectively towards or away from the receptacle 224). The sensor 150 may be an optical sensor. Referring to FIGS. 7-8, the sensor 150 may be disposed on the body 104 of the separator assembly 100 and may be adjacent to the locking pin 146.

The movable body 208 of the pusher assembly 200 may move the coupled separator assembly 100 to a predetermined location. The predetermined location may be preprogrammed into the controller or may be manually input by an operator. As described above, the predetermined location may depend on the size and dimensions of the bags 1 being used, and specifically on the location of the separation region 2 of each bag type.

Figure 10:
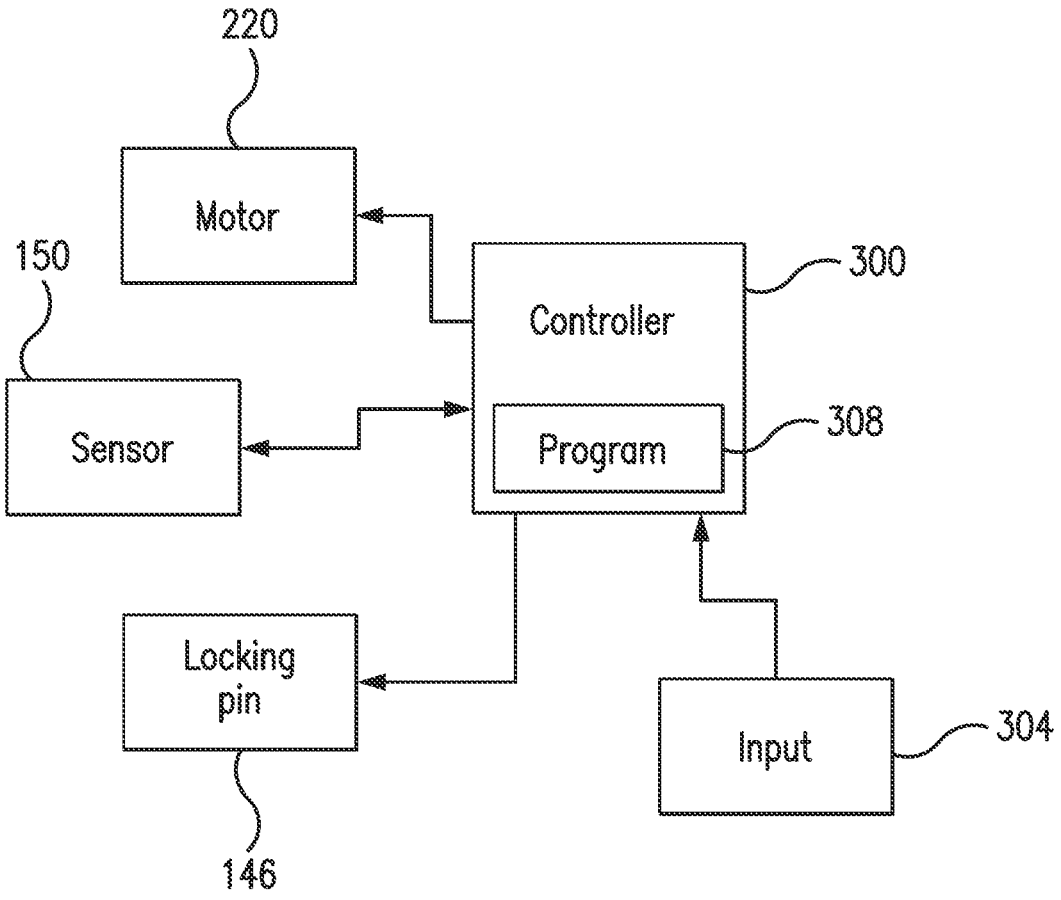
FIG. 10 illustrates a schematic of components of a separator assembly and a pusher assembly according to an aspect of the disclosure.

The pusher assembly 200 is configured to temporarily and releasably act as a transporter for the separator assembly 100. Referring to FIG. 10, the filler assembly 10 may include a controller 300 configured to send and receive signals to various components to control operation thereof, including operation and movement of the separator assembly 100 and the pusher assembly 200. The controller 300 may be configured to send and/or receive signals based on the type of bag 1 that is used with the filler assembly 10. An operator may select the type of bag 1 that will be used via a known input device 304, such as a touchscreen, mouse, keyboard, voice command, physical switch, or another suitable input device. The input device 304 communicates with the controller 300 that includes a program 308 that is associated with the selected bag type. It will be understood that the same program 308 may be utilized for multiple or all of the different bag types, or, alternatively, a separate program 308 is associated with each different bag type. The program 308 includes instructions for moving the separator assembly 100 to the predetermined locations. The controller 300 is configured to communicate the instructions from the program 308 to the motor 220 to cause the motor 220 to move the movable body 208, which also moves the separator assembly 100 when coupled thereto.

Figure 11:
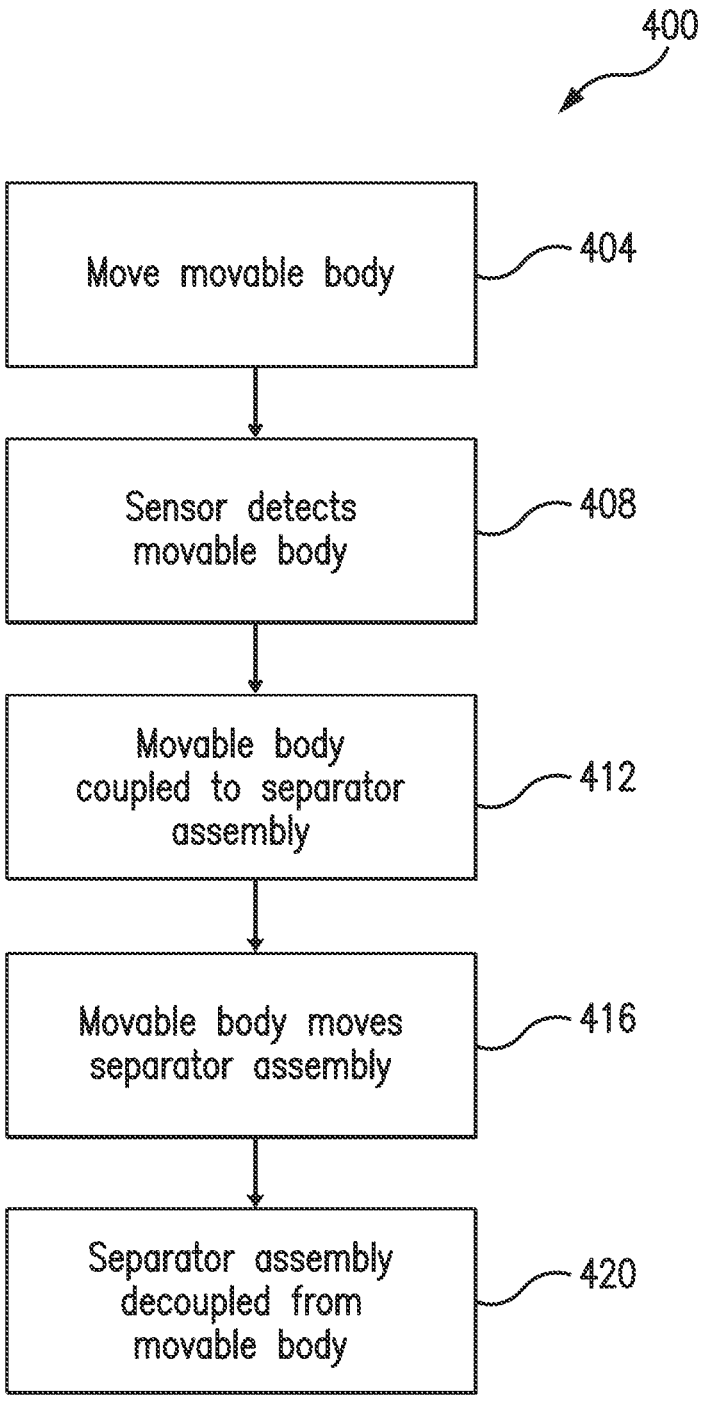
FIG. 11 illustrates a flow chart of a process of positioning a separator assembly according to an aspect of the disclosure.

FIG. 11 depicts the operational process 400 of moving the separator assembly 100 to the desired predetermined location. In step 404, the movable body 208 is moved along the pusher rail 212 towards the separator assembly 100. The movable body 208 is not coupled with the separator assembly 100 at this point.

In step 408, the sensor 150 is operating and optically monitoring for the movable body 208. When the movable body 208 aligns with the sensor 150, the sensor 150 sends a signal to the controller 300 to indicate that the movable body 208 is in the proper alignment with the separator assembly 100. The controller 300 then sends a stop signal to the motor 220, and the motor 220 stops moving the movable body 208. In this position, the movable body 208 should be aligned relative to the separator assembly 100 such that the locking pin 146 and the pin receptacle 224 are positioned opposite one another to allow the locking pin 146 to enter the pin receptacle 224.

In step 412, when the movable body 208 is positioned in the predetermined orientation relative to the separator assembly 100 and the receptacle 224 is aligned with the locking pin 146, the locking pin 146 is moved into the receptacle 224. The movement of the locking pin 146 may be actuated manually by the operator or may be done in response to an electrical signal sent from the controller 300. When the locking pin 146 is in the receptacle 224, the pusher assembly 200 and the separator assembly 100 are coupled together.

In step 416, the controller 300 sends a signal to the motor 220 to cause the motor 220 to move the movable body 208 (and the separator assembly 100 coupled thereto) to the predetermined position. The predetermined position, as described above, may come from the program 308 and may correspond to a particular bag type.

When the separator assembly 100 has been moved to the predetermined position by motor 220 via the coupled movable body 208, then, in step 420, the locking pin 146 is moved out of the receptacle 224, thus decoupling the pusher assembly 200 from the separator assembly 100. The movement of the locking pin 146 may be actuated manually by the operator or may be done in response to an electrical signal sent from the controller 300.

Additional steps may be optionally performed in the above process 400. It will be understood that these steps may occur before, after, or during any of the steps described above, and that the process 400 may include some, all, or none of the optional steps.

In some aspects, before step 404, a step of selecting the bag type may be performed. The operator may select, via one of the method described above, the type of bag 1 that will be used with the filler assembly 10. This selection may determine which program 308 is used and may indicate the specific predetermined position to which the separator assembly should be moved.

In some aspects, before step 404, the pusher assembly 200 may disengage or otherwise move the pusher 204, such that during the proceeding steps, the pusher 204 does not adversely interfere with any components present in the filler assembly 10.

In some aspects, after step 420, and after the pusher assembly 200 is decoupled from the separator assembly 100, the pusher assembly 200 may be moved back to its original starting position or to another position. It will be understood that the pusher assembly 200 may serve other purposes in the filler assembly 10 in addition to moving the separator assembly 100, and so the pusher assembly 200 may be moved by the motor 220 to a position corresponding to any of the other purposes.

Various aspects of separator assemblies 100 can be utilized. In some aspects, the separator assembly 100 may be configured to translate or rotate within the filler assembly 10, and it can be configured to be removable, such that the separator assembly 100 can be disposed in various locations within the filler assembly 10 and in various orientations.

The separator assembly 100 may be used in a horizontal (i.e. flat) position for horizontal filling of the flexible containers 1, or in a vertical position (perpendicular to the horizontal position) for vertical filling of the flexible containers 1. It will be appreciated that the separator assembly 100 may be designed such that it can operate in conjunction with any container filler assembly 10.

While systems and methods have been described in connection with the various aspects of the various figures, it will be appreciated by those skilled in the art that changes could be made to the aspects without departing from the broad inventive concept thereof. It is understood, therefore, that this disclosure is not limited to the particular aspects disclosed, and it is intended to cover modifications within the spirit and scope of the present disclosure as defined by the claims.

What is claimed:

1. A method of positioning a separator assembly to a predetermined location within a container filling assembly, the method comprising:

actuating a motor to move a movable body along a first rail towards the separator assembly mounted on a second rail;

aligning the movable body with the separator assembly;

releasably coupling the movable body to the separator assembly;

moving the separator assembly to the predetermined location; and decoupling the movable body from the separator assembly.

2. The method of claim 1, wherein the separator assembly includes a lock configured to preclude movement thereof, the method further comprising disengaging the lock before the step of moving the separator assembly to the predetermined location.

3. The method of claim 2, further comprising re-engaging the lock after the step of moving the separator assembly to the predetermined location.

4. The method of claim 1, wherein the separator assembly includes a sensor configured to detect movement of the movable body relative to the separator assembly, wherein the aligning step includes determining, via the sensor, when the movable body is positioned at a predetermined alignment position relative to the separator assembly.

5. The method of claim 1, wherein one of the separator assembly and the movable body includes a locking pin, and the other of the separator assembly and the movable body includes a receptacle configured to removably receive the locking pin, and wherein the coupling step further includes moving the locking pin into the receptacle, and the decoupling step further includes moving the locking pin out of the receptacle.

6. The method of claim 1, further comprising communicating with a controller, the controller being configured to send electronic signals to the motor to operate the motor.

7. The method of claim 1, further comprising selecting a type of container to be used before the step of actuating the motor, wherein the predetermined location is based on the selecting step.

8. The method of claim 1, further comprising moving the movable body to a second position different from the predetermined position after the decoupling step.

* * * * *